US008695684B2

(12) United States Patent
Chen et al.

(10) Patent No.: US 8,695,684 B2
(45) Date of Patent: Apr. 15, 2014

(54) METHOD FOR PREPARING ALUMINUM—ZIRCONIUM—TITANIUM—CARBON INTERMEDIATE ALLOY

(75) Inventors: Xuemin Chen, Guangdong (CN); Qingdong Ye, Guangdong (CN); Yueming Yu, Guangdong (CN); Jianguo Li, Guangdong (CN)

(73) Assignee: Shenzhen Sunxing Light Alloys Materials Co., Ltd., Shenzhen (CN)

( * ) Notice: Subject to any disclaimer, the term of this patent is extended or adjusted under 35 U.S.C. 154(b) by 268 days.

(21) Appl. No.: 13/254,522

(22) PCT Filed: Jul. 18, 2011

(86) PCT No.: PCT/CN2011/077241

§ 371 (c)(1), (2), (4) Date: Sep. 2, 2011

(87) PCT Pub. No.: WO2012/065453

PCT Pub. Date: May 24, 2012

(65) Prior Publication Data

US 2012/0037333 A1 Feb. 16, 2012

(30) Foreign Application Priority Data

Jun. 10, 2011 (CN) ..... 2011 1 0155838

(51) Int. Cl.

| | |
|---|---|
| ***B22D 11/00*** | (2006.01) |
| ***B22D 27/02*** | (2006.01) |
| ***B22D 11/10*** | (2006.01) |
| ***C22C 21/00*** | (2006.01) |

(52) U.S. Cl.

USPC ..... 164/462; 164/468; 164/473; 420/552

(58) Field of Classification Search

USPC ..... 164/47, 492, 71.1, 498, 499, 466–468, 164/473, 462; 420/552

See application file for complete search history.

(56) References Cited

U.S. PATENT DOCUMENTS 4,748,001 A * 5/1988 Banerji et al. ..... 420/528
7,615,125 B2 * 11/2009 Bes et al. ..... 148/552

* cited by examiner

*Primary Examiner* — Kevin P Kerns
*Assistant Examiner* — Steven Ha
(74) *Attorney, Agent, or Firm* — Jackson IPG PLLC

(57) ABSTRACT

The present invention discloses a method for producing an aluminum-zirconium-titanium-carbon (Al—Zr—Ti—C) intermediate alloy; the Al—Zr—Ti—C intermediate alloy comprises 0.01% to 10% Zr, 0.01% to 10% Ti, 0.01% to 0.3% C, and Al in balance; the producing method comprising the steps of: preparing commercially pure aluminum, zirconium, titanium, and graphite material according to the weight percentages of the aluminum-zirconium-titanium-carbon intermediate alloy; the graphite powder is subjected to the following treatments: being added to the aqueous solution of KF, NaF, $K_2ZrF6$, $K_2TiF_6$ or the combination thereof, soaked for 12 to 72 hours, filtrated or centrifuged, and dried at 80° C. to 200° C. for 12 to 24 hours; melting the commercially pure aluminum and keeping it at 700° C. to 900° C. to provide aluminum liquid, in which the prepared zirconium, the titanium and the treated graphite powder are added and melted to provide an alloy solution; and keeping the alloys solution at 700° C. to 900° C. under agitation and performing casting molding. The present method produces a high-quality Al—Zr—Ti—C intermediate alloy in low cost.

16 Claims, No Drawings

METHOD FOR PREPARING ALUMINUM—ZIRCONIUM—TITANIUM—CARBON INTERMEDIATE ALLOY

FIELD OF THE INVENTION

The present invention relates to a method for preparing an intermediate alloy serving as a grain refine for improving the properties of metals and alloys, and, in particular, to a method for preparing an aluminum-zirconium-carbon intermediate alloy for refining the grains of magnesium and magnesium alloys.

BACKGROUND OF THE INVENTION

The use of magnesium and magnesium alloy in industries started in 1930s. Since magnesium and magnesium alloys are the lightest structural metallic materials at present, and have the advantages of low density, high specific strength and stiffness, good damping shock absorption, heat conductivity, and electromagnetic shielding performance, excellent machinability, stable part size, easy recovery, and the like, magnesium and magnesium alloys, especially wrought magnesium alloys, possess extremely enormous utilization potential in the filed of transportation, engineering structural materials, and electronics. Wrought magnesium alloy refers to the magnesium alloy formed by plastic molding methods such as extruding, rolling, forging, and the like. However, due to the constraints in, for example, material preparation, processing techniques, anti-corrosion performance and cost, the use of magnesium alloy, especially wrought magnesium alloy, is far behind steel and aluminum alloys in terms of utilization amount, resulting in a tremendous difference between the developing potential and practical application thereof, which never occurs in any other metal materials.

The difference of magnesium from other commonly used metals such as iron, copper, and aluminum lies in that, its alloy exhibits closed-packed hexagonal crystal structure, has only 3 independent slip systems at room temperature, is poor in plastic wrought ability, and is significantly affected in terms of mechanical properties by grain sizes. Magnesium alloy has relatively wide range of crystallization temperature, relatively low heat conductivity, relatively large volume contraction, serious tendency to grain growth coarsening, and defects of generating shrinkage porosity, heat cracking, and the like during setting. Since finer grain size facilitates reducing shrinkage porosity, decreasing the size of the second phase, and reducing defects in forging, the refining of magnesium alloy grains can shorten the diffusion distance required by the solid solution of short grain boundary phases, and in turn improves the efficiency of heat treatment. Additionally, finer grain size contributes to improving the anti-corrosion performance and machinability of the magnesium alloys. The application of grain refiner in refining magnesium alloy melts is an important means for improving the comprehensive performances and forming properties of magnesium alloys. The refining of grain size can not only improve the strength of magnesium alloys, but also the plasticity and toughness thereof, thereby enabling large-scale plastic processing and low-cost industrialization of magnesium alloy materials.

It was found in 1937 that the element that has significantly refining effect for pure magnesium grain size is Zr. Studies have shown that Zr can effectively inhibits the growth of magnesium alloy grains, so as to refine the grain size. Zr can be used in pure Mg, Mg—Zn-based alloys, and Mg-RE-based alloys, but can not be used in Mg—Al-based alloys and Mg—Mn-based alloys, since it has a very small solubility in liquid magnesium, that is, only 0.6 wt % Zr dissolved in liquid magnesium during peritectic reaction, and will be precipitated by forming stable compounds with Al and Mn. Mg—Al-based alloys are the most popular, commercially available magnesium alloys, but have the disadvantages of relatively coarse cast grains, and even coarse columnar crystals and fan-shaped crystals, resulting in difficulties in wrought processing of ingots, tendency to cracking, low finished product rate, poor mechanical property, and very low plastic wrought rate, which adversely affects the industrial production thereof. Therefore, the problem existed in refining magnesium alloy cast grains should be firstly addressed in order to achieve large-scale production. The methods for refining the grains of Mg—Al-based alloys mainly comprise overheating method, rare earth element addition method, and carbon inoculation method. The overheating method is effective to some extent; however, the melt is seriously oxidized. The rare earth element addition method has neither stable nor ideal effect. The carbon inoculation method has the advantages of broad source of raw materials and low operating temperature, and has become the main grain refining method for Mg—Al-based alloys. Conventional carbon inoculation methods add $MgCO_3$, $C_2Cl_6$, or the like to a melt to form large amount of disperse $Al_4C_3$ mass points therein, which are good heterogeneous crystal nucleus for refining the grain size of magnesium alloys. However, such refiners are seldom adopted because their addition often causes the melt to be boiled. In summary, a general-purpose grain intermediate alloy has not been found in the industry of magnesium alloy, and the applicable range of various grain refining methods depends on the alloys or the components thereof. Therefore, one of the keys to achieve the industrialization of magnesium alloys is to find a general-purpose intermediate alloy capable of effectively refining cast grains when solidifying magnesium and magnesium alloys and a method for preparing such grain refining intermediate alloy in low cost and large scale.

SUMMARY OF THE INVENTION

In order to address the above problems existing at present, the present invention provides a method for producing aluminum-zirconium-titanium-carbon (Al—Zr—Ti—C) intermediate alloy, by which high-quality aluminum-zirconium-titanium-carbon (Al—Zr—Ti—C) intermediate alloy for refining the grains of magnesium and magnesium alloys can be continuously produced in low cost and large scale.

The present invention adopts the following technical solution: A method for producing an aluminum-zirconium-titanium-carbon (Al—Zr—Ti—C) intermediate alloy, characterized in that the aluminum-zirconium-titanium-carbon (Al—Zr—Ti—C) intermediate alloy has a chemical composition of 0.01% to 10% Zr, 0.01% to 10% Ti, 0.01% to 0.3% C, and Al in balance, based on weight percentage; the producing method comprising the steps of:

a. preparing commercially pure aluminum, zirconium metal, titanium metal, and graphite material according to the weight percentages of the aluminum-zirconium-titanium-carbon intermediate alloy; the graphite is graphite powder having an average particle size of 0.074 mm to 1 mm; and the graphite powder is subjected to the following treatments: being added to the aqueous solution of KF, NaF, K2ZrF6, K2TiF6 or the combination thereof, soaked for 12 to 72 hours, filtrated or centrifuged, and dried at 80° C. to 200° C. for 12 to 24 hours;

b. melting the commercially pure aluminum and keeping it at 700° C. to 900° C. to provide aluminum liquid, in which the prepared zirconium, titanium and the treated graphite powder are added and melted to provide an alloy solution; and c. keeping the alloys solution at 700° C. to 900° C. under mechanical or electromagnetic agitation and performing casting molding.

Preferably, the aluminum-zirconium-titanium-carbon (Al—Zr—Ti—C) intermediate alloy has a chemical composition of 0.1% to 10% Zr, 0.1% to 10% Ti, 0.01% to 0.3% C, and Al in balance. A more preferable chemical composition is: 1% to 5% Zr, 1% to 5% Ti, 0.1% to 0.3% C, and Al in balance.

Preferably, the contents of impurities in the aluminum-zirconium-titanium-carbon (Al—Zr—Ti—C) intermediate alloy are: Fe of no more than 0.5%, Si of no more than 0.3%, Cu of no more than 0.2%, Cr of no more than 0.2%, and other single impurity element of no more than 0.2%, based on weight percentage.

Preferably, the zirconium metal (Zr) in the step a is zirconium scrap or zirconium powder having an average particle size of 0.1 mm to 1 mm, and the metal titanium (Ti) is titanium sponge or titanium scrap.

Preferably, the graphite powder has an average particle size large than or equal to 0.335 mm and smaller than or equal to 1 mm. Alternatively, the graphite powder preferably has an average particle size large than or equal to 0.154 mm and smaller than 0.335 mm.

Preferably, the aqueous solution of KF, NaF, $K_2ZrF_6$, $K_2TiF_6$ or the combination thereof has a concentration of 0.1 g/L to 5 g/L.

Preferably, when the graphite powder is soaked, the aqueous solution has a temperature of 50° C. to 100° C.

Preferably, the zirconium, the titanium and the treated graphite powder are added in step b in the order of: firstly the zirconium and the titanium, and secondly the treated graphite powder after the zirconium and the titanium being completely melted; or firstly the treated graphite powder, and secondly the zirconium and the titanium after the treated graphite powder being completely melted.

Preferably, the casting molding in step c adopts casting and rolling to form wire material having a diameter of 9 to 10 mm.

The present invention achieves the following technical effects: graphite can be completely melt in aluminum liquid having relatively low temperature (900° C. or lower) by selecting graphite powder having an appropriate particle size and soaking the same in appropriate solutions, which addresses not only the problem about the tendency of aluminum liquid to be oxidized at a high temperature of 1000° C. or higher, but also the problem about the melting and incorporating of graphite, providing high-quality aluminum-zirconium-titanium-carbon (Al—Zr—Ti—C) intermediate alloy. The present method has the advantages of broad sources of raw materials, simple process, low producing cost, and large-scale production.

DETAILED DESCRIPTION

The present invention can be further clearly understood in combination with the particular examples given below, which, however, are not intended to limit the scope of the present invention.

Example 1

Commercially pure aluminum, zirconium scrap, titanium scrap and graphite powder were weighed in a weight ratio of 94.85% Al, 3% Zr, 2% Ti, and 0.15% C. The graphite powder had an average particle size of 0.27 mm to 0.83 mm. The graphite powder was soaked in 2 g/L KF aqueous solution at 65±3 for 24 hours, filtrated to remove the solution, dried at 120±5° C. for 20 hours, and then cooled to room temperature for use. Aluminum ingots were added to an induction furnace, melt, and heated to a temperature of 770±10° C., in which the zirconium scrap, the titanium sponge and the soaked graphite powder were sequentially added and completely dissolved under agitation. The resultant mixture was kept at the temperature, continuously and mechanically agitated to be homogenized, and then directly cast to provide aluminium-zirconium-titanium-carbon intermediate alloy.

Example 2

Commercially pure aluminum, zirconium scrap, titanium scrap and graphite powder were weighed in a weight ratio of 94.5% Al, 4.2% Zr, 1.1% Ti, and 0.2% C. The graphite powder had an average particle size of 0.27 mm to 0.55 mm. The graphite powder was soaked in 0.5 g/L $K_2TiF_6$ aqueous solution at 90±3° C. for 36 hours, filtrated to remove the solution, dried at 100±5° C. for 24 hours, and then cooled to room temperature for use. The aluminum ingot was added to an induction furnace, melt, and heated to a temperature of 870±10° C., in which the zirconium scrap, the titanium scrap and the soaked graphite powder were sequentially added and completely dissolved under agitation. The resultant mixture was kept at the temperature, continuously and mechanically agitated to be homogenized, and then processed by casting and rolling into coiled wires of aluminum-zirconium-titanium-carbon intermediate alloy having a diameter of 9.5 mm.

Example 3

Commercially pure aluminum, zirconium scrap, titanium scrap and graphite powder were weighed in a weight ratio of 94.2% Al, 1% Zr, 4.7% Ti, and 0.1% C. The graphite powder had an average particle size of 0.15 mm to 0.25 mm. The graphite powder was soaked in 0.3 g/L $K_2ZrF_6$ aqueous solution at 70±3° C. for 48 hours, filtrated to remove the solution, dried at 170±5° C. for 12 hours, and then cooled to room temperature for use. Aluminum ingots were added to an induction furnace, melt, and heated to a temperature of 730±10° C., in which the soaked graphite powder, the titanium scrap and the zirconium scrap were sequentially added and completely dissolved under agitation. The resultant mixture was kept at the temperature, continuously and electromagnetically agitated to be homogenized, and then processed by casting and rolling into coiled wires of aluminum-zirconium-titanium-carbon intermediate alloy having a diameter of 9.5 mm.

Example 4

Commercially pure aluminum, zirconium scrap, titanium scrap and graphite powder were weighed in a weight ratio of 93.9% Al, 2.5% Zr, 3.3% Ti, and 0.3% C. The graphite powder had an average particle size of 0.08 mm to 0.12 mm. The graphite powder was soaked in 4.5 g/L NaF aqueous solution at 55±3° C. for 72 hours, filtrated to remove the solution, dried at 140±5° C. for 22 hours, and then cooled to room temperature for use. Aluminum ingots were added to an induction furnace, melt, and heated to a temperature of 830±10° C., in which the soaked graphite powder, the zirconium scrap, and the titanium scrap were sequentially added and completely dissolved under agitation. The resultant mixture was kept at the temperature, continuously and mechanically agitated to be homogenized, and then processed by casting and rolling into coiled wires of aluminum-zirconium-titanium-carbon intermediate alloy having a diameter of 9.5 mm.

Example 5

Commercially pure aluminum, zirconium scrap, titanium sponge and graphite powder were weighed in a weight ratio of 83.78% Al, 9.7% Zr, 6.2% Ti, and 0.3% C. The graphite powder had an average particle size of 0.27 mm to 0.83 mm. The graphite powder was soaked in 4 g/L KF aqueous solution at 95±3° C. for 48 hours, filtrated to remove the solution, dried at 160±5° C. for 20 hours, and then cooled to room temperature for use. Aluminum ingots were added to an induction furnace, melt, and heated to a temperature of 720±10° C., in which the zirconium scrap, the titanium sponge and the soaked graphite powder were sequentially added and completely dissolved under agitation. The resultant mixture was kept at the temperature, continuously and mechanically agitated to be homogenized, and then processed by casting and rolling into coiled wires of aluminum-zirconium-titanium-carbon intermediate alloy having a diameter of 9.5 mm.

Example 6

Commercially pure aluminum, zirconium powder, titanium scrap and graphite powder were weighed in a weight ratio of 99.57% Al, 0.1% Zr, 0.3% Ti, and 0.03% C. The zirconium powder has an average particle size of 0.4 mm to 0.7 mm, and the graphite powder had an average particle size of 0.27 mm to 0.55 mm. The graphite powder was soaked in a mixed aqueous solution of 1.2 g/L $K_2TiF_6$ and 0.5 g/L KF at 87±3° C. for 36 hours, filtrated to remove the solution, dried at 110±5° C. for 20 hours, and then cooled to room temperature for use. Aluminum ingots were added to an induction furnace, melt, and heated to a temperature of 810±10° C., in which the zirconium powder, the titanium scrap and the soaked graphite powder were sequentially added and completely dissolved under agitation. The resultant mixture was kept at the temperature, continuously and mechanically agitated to be homogenized, and then processed by casting and rolling into coiled wires of aluminum-zirconium-titanium-carbon intermediate alloy having a diameter of 9.5 mm.

Example 7

Pure magnesium was melt in an induction furnace under the protection of a mixture gas of $SF_6$ and $CO_2$, and heated to a temperature of 710° C., to which 1% Al—Zr—Ti—C intermediate alloy prepared according to examples 1-6 were respectively added to perform grain refining The resultant mixture was kept at the temperature under mechanical agitation for 30 minutes, and directly cast into ingots to provide 6 groups of magnesium alloy sample subjected to grain refining.

The grain size of the samples were evaluated under GB/T 6394-2002 for the circular range defined by a radius of ½ to ¾ from the center of the samples. Two fields of view were defined in each of the four quadrants over the circular range, that is, 8 in total, and the grain size was calculated by cut-off point method.

The pure magnesium without grain refining exhibited columnar grains having a width of 300 μm~2000 μm and in scattering state. The 6 groups of magnesium alloys subjected to grain refining exhibited equiaxed grains with a width of 50 μm~200 μm.

The results of the tests show that the Al—Zr—Ti—C intermediate alloys according to the present invention have very good effect in refining the grains of pure magnesium.

What is claimed is:

1. A method for producing an aluminum-zirconium-titanium-carbon intermediate alloy, characterized in that the aluminum-zirconium-titanium-carbon intermediate alloy has a chemical composition of 0.01% to 10% Zr, 0.01% to 10% Ti, 0.01% to 0.3% C, and Al in balance, based on weight percentage; the producing method comprising the steps of:

a. preparing commercially pure aluminum, zirconium metal, titanium metal, and graphite material according to the weight percentages of the aluminum-zirconium-titanium-carbon intermediate alloy; the graphite is graphite powder having an average particle size of 0.074 mm to 1 mm; and the graphite powder is subjected to the following treatments: being added to an aqueous solution of KF, NaF, $K_2ZrF_6$, $K_2TiF_6$ or a combination thereof, soaked for 12 to 72 hours, filtrated or centrifuged, and dried at 80° C. to 200° C. for 12 to 24 hours;

b. melting the commercially pure aluminum and keeping it at 700° C. to 900° C. to provide aluminum liquid, in which a prepared zirconium, titanium and the treated graphite powder are added and melted to provide an alloy solution; and c. keeping the alloys solution at 700° C. to 900° C. under mechanical or electromagnetic agitation and performing casting.

2. The method for producing an aluminum-zirconium-titanium-carbon intermediate alloy according to claim 1, wherein the contents of impurities present in the aluminum-zirconium-carbon intermediate alloy are: Fe of no more than 0.5%, Si of no more than 0.3%, Cu of no more than 0.2%, Cr of no more than 0.2%, and other single impurity element of no more than 0.2%, based on weight percentage.

3. The method for producing an aluminum-zirconium-titanium-carbon intermediate alloy according to claim 1, wherein the zirconium metal in the step a is zirconium scrap or zirconium powder having an average particle size of 0.1 mm to 1 mm, and the titanium metal is sponge titanium or titanium scrap.

4. The method for producing an aluminum-zirconium-titanium-carbon intermediate alloy according to claim 1, wherein the graphite powder has an average particle size of 0.335 mm to 1 mm.

5. The method for producing an aluminum-zirconium-titanium-carbon intermediate alloy according to claim 1, wherein the graphite powder has an average particle size of 0.154 mm to 0.335 mm.

6. The method for producing an aluminum-zirconium-titanium-carbon intermediate alloy according to claim 1, wherein the aqueous solution of KF, NaF, $K_2ZrF_6$, $K_2TiF_6$ or the combination thereof has a concentration of 0.1 g/L to 5 g/L.

7. The method for producing an aluminum-zirconium-titanium-carbon intermediate alloy according to claim 1, wherein when the graphite powder is soaked, the aqueous solution has a temperature of 50° C. to 100° C.

8. The method for producing an aluminum-zirconium-titanium-carbon intermediate alloy according to claim 1, wherein the zirconium, the titanium, and the treated graphite powder are added in step b in the order of: firstly the zirconium and the titanium, and secondly the treated graphite powder after the zirconium and the titanium being completely melted; or firstly the treated graphite powder, and secondly the zirconium and the titanium after the treated graphite powder being completely melted.

9. The method for producing an aluminum-zirconium-titanium-carbon intermediate alloy according to claim 1, wherein the casting molding in step c adopts casting and rolling to form wire material having a diameter of 9 to 10 mm.

10. The method for producing an aluminum-zirconium-titanium-carbon intermediate alloy according to claim 2, wherein the zirconium metal in the step a is zirconium scrap or zirconium powder having an average particle size of 0.1 mm to 1 mm, and the titanium metal is sponge titanium or titanium scrap.

11. The method for producing an aluminum-zirconium-titanium-carbon intermediate alloy according to claim 2, wherein the graphite powder has an average particle size of 0.335 mm to 1 mm.

12. The method for producing an aluminum-zirconium-titanium-carbon intermediate alloy according to claim 2, wherein the graphite powder has an average particle size of 0.154 mm to 0.335 mm.

13. The method for producing an aluminum-zirconium-titanium-carbon intermediate alloy according to claim 2, wherein the aqueous solution of KF, NaF, $K_2ZrF_6$, $K_2TiF_6$ or the combination thereof has a concentration of 0.1 g/L to 5 g/L.

14. The method for producing an aluminum-zirconium-titanium-carbon intermediate alloy according to claim 2, wherein when the graphite powder is soaked, the aqueous solution has a temperature of 50° C. to 100° C.

15. The method for producing an aluminum-zirconium-titanium-carbon intermediate alloy according to claim 2, wherein the zirconium, the titanium, and the treated graphite powder are added in step b in the order of: firstly the zirconium and the titanium, and secondly the treated graphite powder after the zirconium and the titanium being completely melted; or firstly the treated graphite powder, and secondly the zirconium and the titanium after the treated graphite powder being completely melted.

16. The method for producing an aluminum-zirconium-titanium-carbon intermediate alloy according to claim 2, wherein the casting in step c adopts casting and rolling to form wire material having a diameter of 9 to 10 mm.

* * * * *